US005799794A

United States Patent [19]

Whitnell

[11] Patent Number: 5,799,794

[45] Date of Patent: Sep. 1, 1998

[54] SAUCE CUP TRAY

[75] Inventor: Simon Whitnell, Exton, Pa.

[73] Assignee: Dopaco, Inc., Exton, Pa.

[21] Appl. No.: 756,938

[22] Filed: Dec. 2, 1996

[51] Int. Cl.[6] ..... B65D 1/34

[52] U.S. Cl. ..... 206/562; 206/549; 206/565; 229/904; 220/4.24

[58] Field of Search ..... 206/562, 563, 206/565, 541, 549; 229/904, 905, 906; 220/737, 4.23, 4.24; 426/112, 115, 119, 120

[56] References Cited

U.S. PATENT DOCUMENTS

| | | | |
|---|---|---|---|
| 2,640,589 | 6/1953 | Foster et al. | 206/562 |
| 3,005,584 | 10/1961 | Coe | 206/562 |
| 3,244,352 | 4/1966 | Reach | 229/906 |
| 3,434,650 | 3/1969 | Goings | 229/904 |
| 3,499,595 | 3/1970 | Brooks | 229/904 |
| 4,155,502 | 5/1979 | Forte | 206/194 |
| 4,653,685 | 3/1987 | Leary et al. | 426/115 |
| 4,694,987 | 9/1987 | Forbes, Jr. . | |
| 4,895,259 | 1/1990 | Paley . | |
| 4,940,190 | 7/1990 | Groves | 229/906 |
| 5,221,040 | 6/1993 | Sorenson | 229/906 |
| 5,301,871 | 4/1994 | Gross et al. . | |

*Primary Examiner*—Paul T. Sewell
*Assistant Examiner*—Nhan T. Lam
*Attorney, Agent, or Firm*—Dennison, Meserole, Pollack & Scheiner

[57] ABSTRACT

A sauce cup accommodating tray including an elongate tapered bottom panel with a cup-receiving opening through one end thereof and with peripheral walls including an end wall remote from the opening to define a food receiving compartment between the sauce cup and end wall. A selectively removable cover can be provided for pivotal closure over the tray, the cover including an opening aligned with the tray opening for insertion of a sauce cup directly into and through both openings as a locking mechanism.

14 Claims, 3 Drawing Sheets

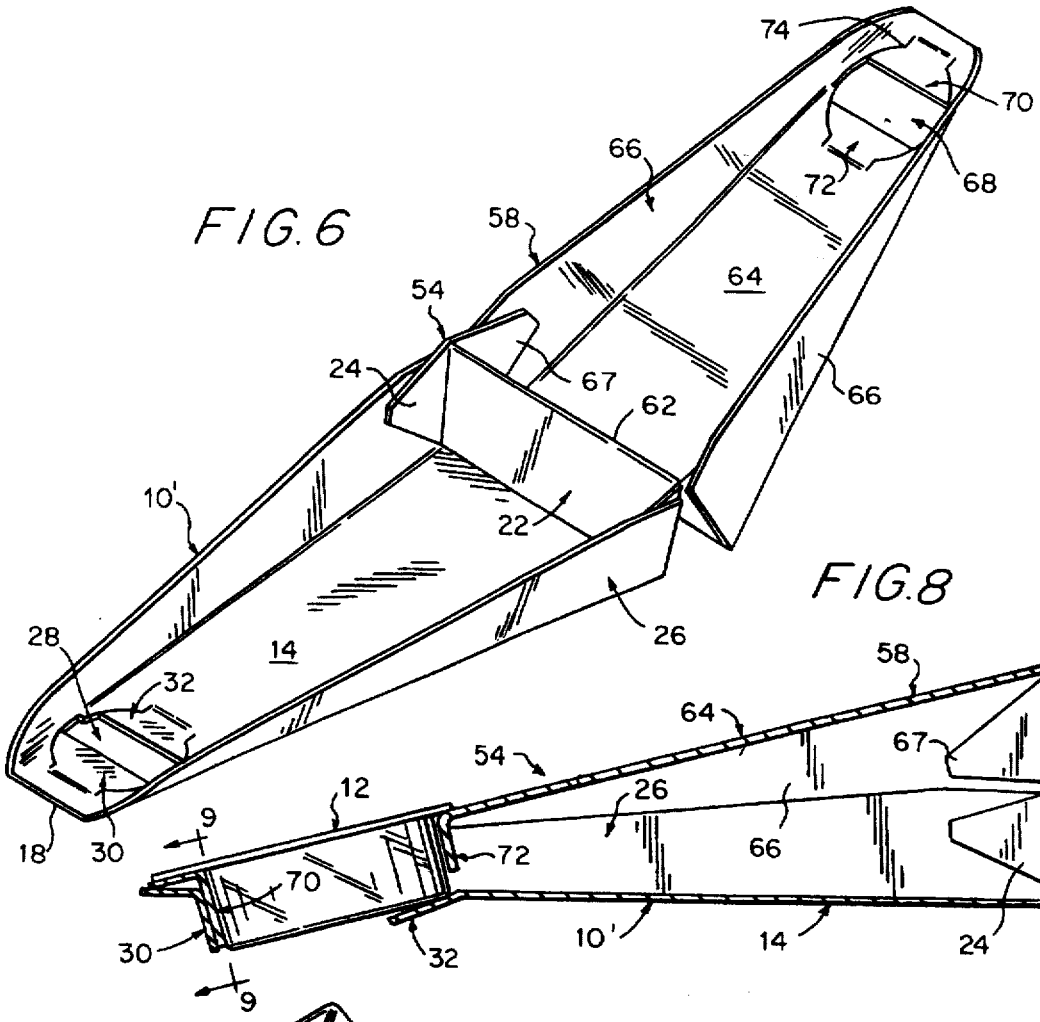
FIG. 6
FIG. 8
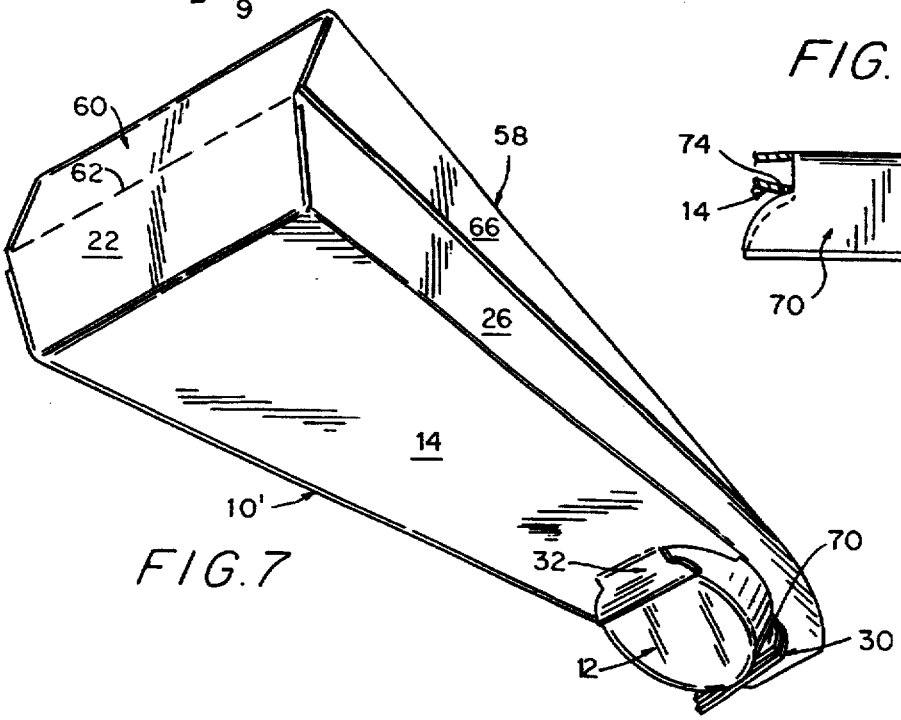
FIG. 7
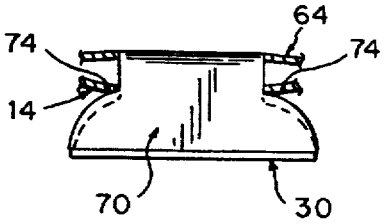
FIG. 9

SAUCE CUP TRAY

BACKGROUND OF THE INVENTION

Fast food containers, normally foldable paperboard or the like, are formed in a wide variety of configurations, usually in accordance with the particular type of foodstuff to be received therein.

One form of carton, exemplified by the Paley U.S. Pat. No. 4,895,259, issued Jan. 23, 1990, is specifically intended to accommodate a finger food and a sauce cup.

This carton, as well as other known cartons intended to accommodate multiple food products, are normally relatively complex structures requiring a substantial amount of board material and rather elaborate folding and assembly procedures, all of which adds to the expense of the carton. Inasmuch as such cartons are only single-use disposable items, and as such cartons are used by the thousands, any reduction in the costs of a single carton, whether by reducing the amount of material required or by simplifying the construction and assembly of the carton will produce significant economic advantages.

SUMMARY OF THE INVENTION

The carton of the invention is specifically intended for the accommodation of a finger food and a sauce cup. This can be french fries with a cup containing ketchup, chips or sliced vegetables with a dip, or any other combination wherein one food product is retained in a tray-like compartment and the companion food product within a sauce cup.

The carton as described herein comprises an upwardly open walled tray with a sauce receiving aperture through one end thereof. The tray, particularly when used for take-out, may include an integral cover or lid defined by a duplicate overlying inverted tray.

The basic tray is of a uniquely simple construction tapering forwardly from a relatively wide rear end to a narrower front end. Rear and side walls fold upwardly from the base or bottom panel with glue flaps securing the opposed ends of the rear wall to the two side walls. As such, the basic tray is formed utilizing only three fold lines and two glue flaps. No elaborate assembly procedures are involved.

The opposed side walls taper forwardly toward the front or forward end of the tray and flare slightly outward to substantially merge into the plane of the bottom panel at the forward end.

The tray is completed by an opening through the bottom panel immediately inward of the forward end of the bottom panel and between the opposed side walls for the accommodation therethrough of a sauce cup. The opening has overlying forward and rear flaps which, upon insertion of the sauce cup, fold outward and downward from the plane of the bottom panel to embrace the sides of the sauce cup and, therewith, provide a stand slightly elevating the forward end of the tray to generally direct the foodstuff within the tray rearward of the sauce cup toward the rear wall, thus avoiding any tendency for the foodstuff to slide into the sauce cup when opened.

The carton comprising both the tray and a cover is formed from a unitary blank with the cover as an inverted duplicate of the tray. As such, the rear wall of the tray and the rear wall of the cover are integrally joined along the upper edges thereof for a selective folding of the cover over the tray with the openings in the cover and tray aligned. So positioned, the sauce tray can be inserted through the opening in the cover and downward at least partially through the opening in the underlying tray with the corresponding flaps, or portions thereof, interlocking for a releasable securing of the cover in its closed position. In other words, the separate sauce tray will act as a means for interlocking the cover to the tray. As will be appreciated, the sauce tray can, as an alternate, be mounted within the tray and overlaid by the cover. However, the desired locking effect would not be achieved with such an arrangement.

Other features and advantages of the carton of the invention will become apparent from the more detailed description of the invention following hereinafter.

BRIEF DESCRIPTION OF THE DRAWINGS

FIG. 6 is a top perspective view of the covered carton with the cover open;

FIG. 7 is a bottom perspective view of the closed carton with the sauce tray inserted through the openings in both the cover and tray;

FIG. 8 is a longitudinal cross-sectional view through the covered carton with the sauce tray shown in elevation; and FIG. 9 is cross-sectional detail taken substantially on a plane passing along line 9—9 in FIG. 8 and illustrating the interlock between the cover and tray flaps.

DESCRIPTION OF PREFERRED EMBODIMENTS

Figure 1:
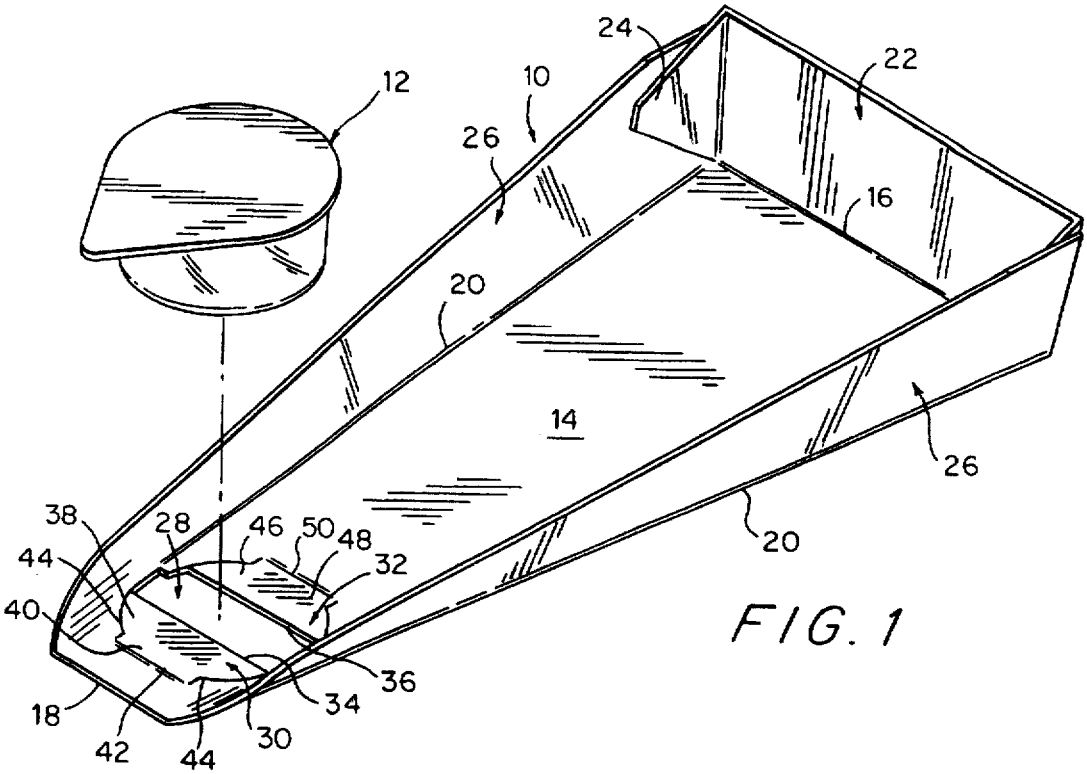
FIG. 1 is a top perspective view of the tray carton of the invention with a sauce cup exploded upward therefrom.

Referring now more specifically to the drawings, the basic carton of the invention is in the form of an upwardly opening one-piece tray 10 which is adapted to receive and temporarily mount a sauce cup 12 in a manner specifically so as to enable a physical handling of the tray and sauce cup as a unit.

The tray 10 includes a planar bottom panel 14 tapering forwardly from a wide rear end 16 to a relatively narrower front end 18, defining a substantially triangular configuration with equal length opposed sides 20.

A rear wall 22 is coextensive with the rear end 16 of the bottom panel 14 and is upwardly folded therefrom, along a fold line coextensive with the panel end 16, to extend substantially perpendicularly thereto. The opposed vertical ends of the rear wall 22 are provided with forwardly folding glue or adhesive flaps 24.

Opposed side walls 26 are coextensive and integral with the bottom panel sides 20 and upwardly folded from fold lines defined along the sides 20. The side walls 26 are of a constantly tapering configuration from a maximum height adjacent the opposed ends of the rear wall 22 whereat the flaps 24 of the rear wall 22 overly the inner faces of the side walls 26 and are adhesively fixed thereto to retain the rear portions of the side walls substantially perpendicular to both the rear wall 22 and the bottom panel 14. As the side walls taper and extend forwardly, they gradually incline outward at progressively greater angles away from the perpendicular, to lie only slightly upward relative to the plane of the bottom panel 14 adjacent the front end 18 thereof. The progressively shorter and outwardly flared side walls provide a front open end with an unencumbered free edge which, as desired, can be used in the manner of a scoop to assist in the loading of finger food onto the upper surface of the bottom panel and progressively inward toward the relatively higher upright rear wall 22 and adjoining upright rear portions of the side walls 26.

In order to accommodate the sauce cup 12, the bottom panel of the tray 10 is provided with an opening or aperture 28 therethrough at a point slightly inwardly spaced from the front end 18. The opening 28 will be configured or have a periphery slightly larger than and generally conforming to the configuration of the body portion of the sauce cup 12. For example and as illustrated, a substantially circular opening will be provided to accommodate a cylindrical sauce cup.

The opening 28, prior to insertion of the sauce cup 12 is partially closed by forward and rear segment-shaped flaps 30 and 32 with opposed spaced inner edges 34 and 36 respectively, the edges extending transversely of the length of the bottom panel 14.

The forward flap 30 is larger than the rear flap 32, covering a slightly greater segment of the opening 28. The forward flap 30 includes a segment-shaped head portion 38 which actually defines the corresponding portion of the opening 28, and an integral forwardly extending projection or projecting portion 40 which extends forwardly of the practical periphery of the opening 28 and is integral with the bottom panel 14 along fold line 42 which parallels the forward or front end 18 of the bottom panel 14. The remainder of the flap 30 is completely or at least partially severed from the bottom panel 14 for a downward folding thereof upon insertion of the sauce cup. As will be noted, as the projection 40 is transversely narrower than the segment-configured head portion 38, a pair of opposed shoulder areas 44 are defined on the periphery of the head portion 38 to each side of the projecting portion 40. Noting FIGS. 1 and 4 in particular, it will be seen that the forward portion of the opening 28 defined by the forward flap 30 is, in effect, formed by the opposed converging side walls 26 and an approximately equal width portion of the bottom panel 14 between the forward end 18 thereof and the flap fold line 42.

The rear flap 32, while smaller than the flap 30 is similarly configured with an enlarged segment-shaped head portion 46 which defines the corresponding portion of the opening 28, and a rearwardly directed projecting portion or projection 48 which is integral with the bottom panel 14 along fold line 50.

Figure 2:
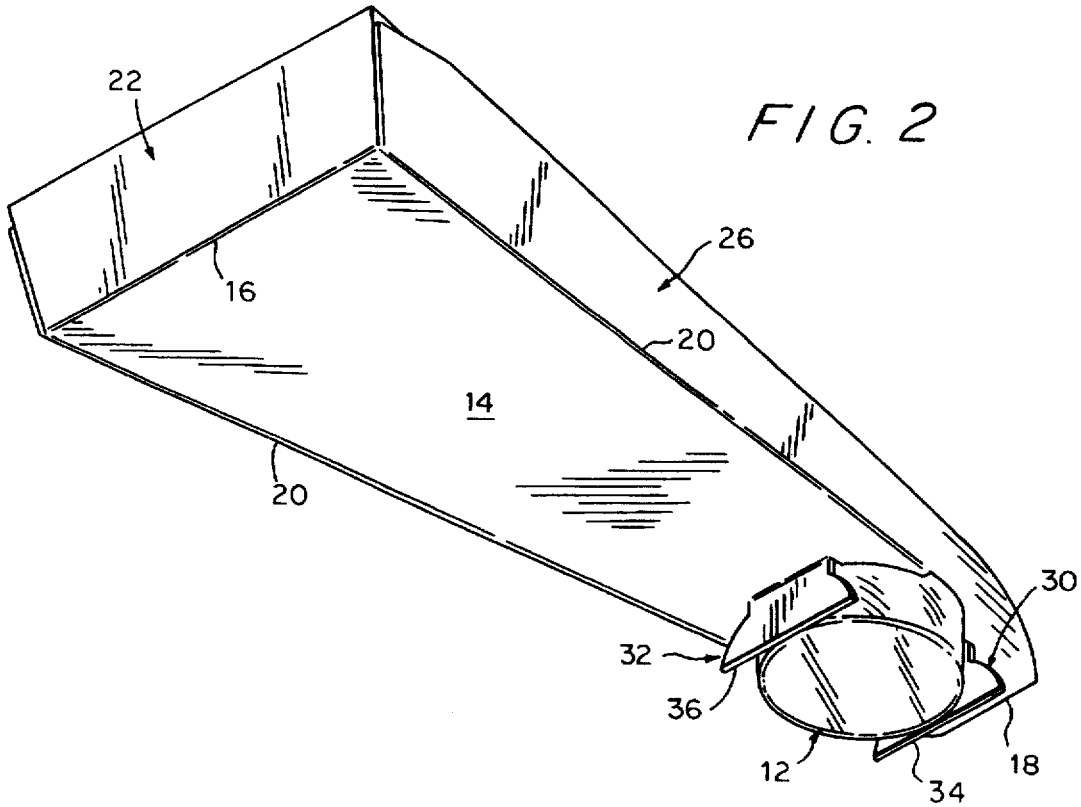
FIG. 2 is a bottom perspective view of the tray with the sauce tray inserted in its stored position.
Figure 3:
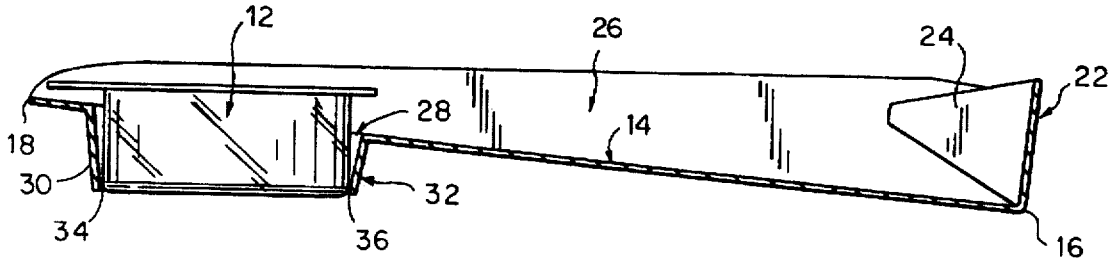
FIG. 3 is a longitudinal cross-sectional view through the tray with the sauce cup shown in elevation.

Noting FIGS. 2 and 3 in particular, upon insertion of the sauce cup 12, the flaps 30 and 32 are downwardly folded to form support legs for the tray 10 with the bottom panel 14 elevated at the front end portion thereof and sloping rearwardly toward the rear wall 22 whereby foodstuff on the upper surface of the bottom panel 14 would tend to move slightly away from the sauce cup for free access thereto. Similarly, the bottom or lower surface of the bottom panel 14 to will be upwardly spaced from the tabletop or counter support surface as would be desirable when, as an example, containing hot food products, such as french fries and the like.

The greater height of the support leg provided by the front flap 30 and the corresponding lessor height of the support leg provided by the folded rear flap 32 are so related as to enable both to engage the support surface while maintaining the desired sloping or inclination of the bottom panel 14. The flap radial projections 40 and 48 allow for a downward folding of the flaps 30 and 32 about the fold lines 42 and 50 slightly outward of the periphery of the opening 28 so as to completely free the opening for rather close reception of the body of the sauce cup 12. The presence of the sauce cup 12 through the opening 28 retains the flaps 30 and 32 in their downward folded positions, hence stabilizing the tray. It will be noted that the forward flap 30 is approximately equal to the height of the sauce cup 12. It is also to be appreciated that as the narrow portion of the tray 10 is only slightly wider than the sauce cup itself, the tray 10 is easily handled by grasping the forward portion of the tray by a single hand engaged about both the tray and the received sauce cup with the foodstuff effectively retained thereon between the rear wall 22 and the forwardly located sauce cup 12.

Figure 4:
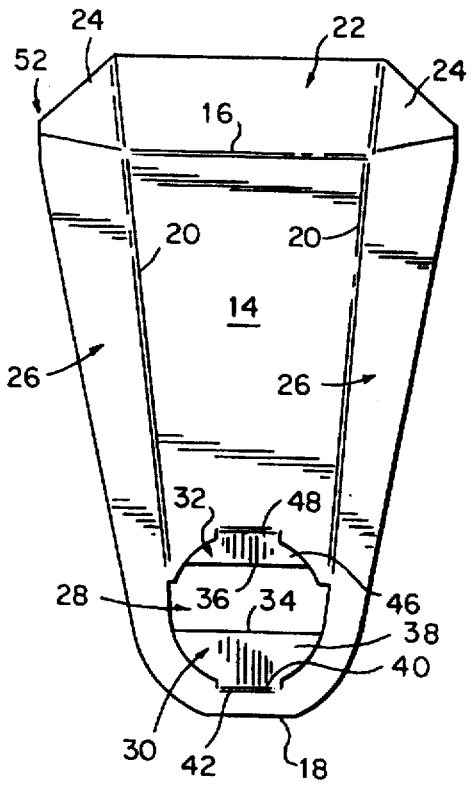
FIG. 4 is a plan view of the blank from which the tray is folded.
Figure 5:
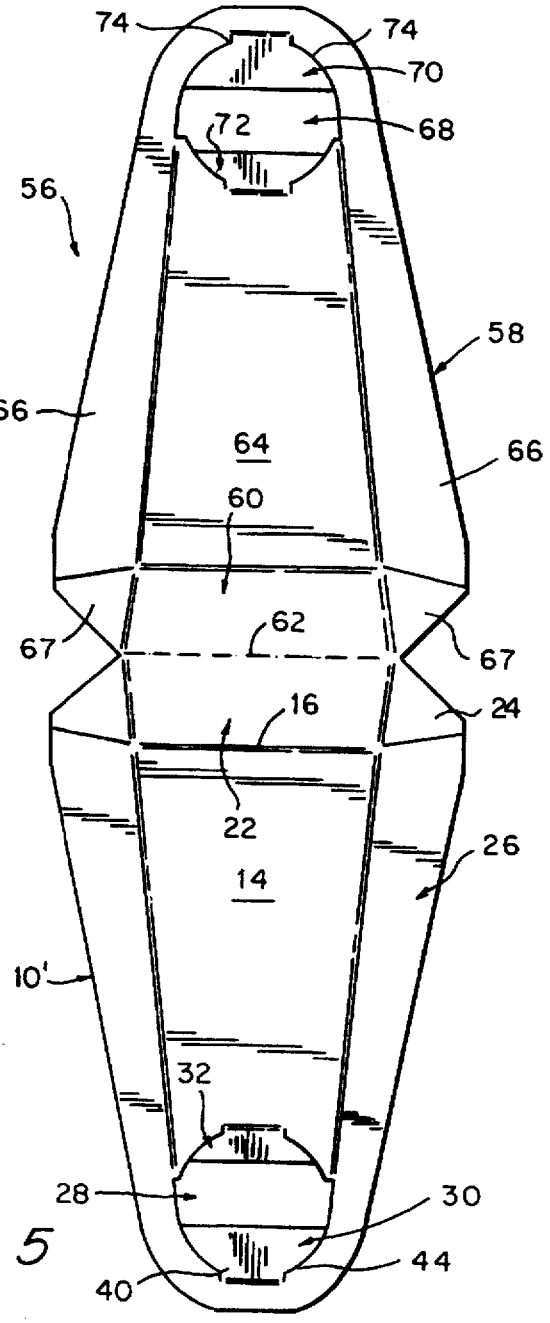
FIG. 5 is a plan view of the blank from which the covered carton is folded, such including both the basic tray and an integral cover.

The blank 52 from which the tray 10 is folded is illustrated in FIG. 4, and the portions of the blank which define the various components of the tray have been designated by the same reference numerals for ease of identification. The simplicity of the blank, including little waste or scrap areas, minimal fold lines and joinder areas or glue tabs, and the like, when coupled with assembly procedure requiring only the adhesive securing of the opposed ends of the rear wall to the adjoining rear portions of the side walls, substantially enhances the novelty, practically and economic feasibility of the tray. The resultant structure uniquely accommodates both a food product in the manner of finger food and a sauce cup which, when positioned in the tray, orients the tray for use as a serving dish from which the food product can be directly and easily consumed.

Referring now to FIGS. 5–9, the carton 54 and corresponding blank 56 illustrated therein disclose a variation wherein a closure or cover 58 is provided for the tray 10'. Inasmuch as the covered tray 10' is a duplicate of the previously described open tray 10, like reference numerals have been applied to the components and features thereof.

The cover 58 is also a substantial duplicate of the basic tray 10, and as such includes a rear wall 60 which is integrally formed with the rear wall 22 of the tray 10' along a fold line 62 defining the respective upper edges of the rear walls 60 and 22. The cover 58, similar to the trays 10 and 10', include a forwardly tapering base panel 64 with opposed forwardly tapering side walls 66 secured to the opposed ends of the rear wall 60 by glue flaps 67 which fold from the opposed ends of the rear wall 60 to overly the rear portions of the side walls 66. The cover 58 also includes an opening 68 with partially overlying forward and rear foldable flaps 70 and 72, duplicating the opening and flaps 28, 30 and 32 of the tray and positioned to overly and align with the tray opening 28 upon a closure of the cover 58 over the integral tray 10', note in particular FIG. 8.

Inasmuch as the tray 10' and cover 58 are duplicates or substantial duplicates, in order to facilitate a closing of the cover 58 over the tray 10', as the cover 58 is being closed, the opposed walls 26 of the tray 10' will be slightly inwardly compressed with the corresponding walls 66 of the cover outwardly overlapping or overlying the tray walls 26 for a rather complete enclosure of foodstuff received on the tray 10'.

The fold line 62 between the integral tray 10' and cover 58 also preferably functions as a severance line formed, for example, by a line of perforations. This will allow a removal of the cover 58 from the tray either for a disposal of the cover upon an opening of the carton 56 or for use of the cover as a separate tray.

While the sauce cup 12 can mount through the opening 28 in the covered tray 10', it is preferred, as illustrated in FIGS. 7 and 8, that the sauce tray be inserted downwardly through the opening 68 in the closed cover 58 and into the underlying tray opening 28. In such case, the forward flap 70 of the cover will fold downward and engage the forward flap 30 of the underlying tray whereby the flaps overly each other and extend downward from the undersurface of the tray 10' to provide a support leg which combines with the rear edge of the bottom panel 14 of the tray 10' to support the intermediate portion of the bottom panel above the support surface. Note in FIG. 9, as the forward flaps 70 and 30 are folded downward, the cover flap 70 will tend to engage the formed shoulder portions 74 thereon with the undersurface of the bottom panel 14 of the tray to provide a locking effect between the cover and the tray to maintain the sealed relationship between the cover and tray. As will be appreciated, the shoulders 74 are duplicates of the previously described shoulders 44 associated with the front flap 30 of the basic tray 10. The locking engagement of the shoulders 74 with the undersurface of the tray bottom panel is readily releasable, particularly upon removal of the sauce cup as a preliminary step to accessing the food product within the tray.

The rear flap 72 of the cover will, upon insertion of the sauce cup 12, fold downward generally perpendicular to the base panel 64 of the cover and both partially seal the food receiving portion of the carton inward of the sauce cup 12 and act as an insulating barrier between the food and the sauce cup. The rear flap 32 of the tray 10' will normally, depending upon the height of the sauce cup, act as a partial support for the inner end of the sauce cup.

From the foregoing, it will be appreciated that the invention presents a unique construction which minimizes the amount of board material required, thus providing an ecologically and economically desirable product. Similarly, the use of minimal board material and the manner in which the finished product is assembled, greatly reduces manufacturing costs.

The tray and tray and cover combination, in addition to the ecological and economical advantages thereof, provides an effective container for the food product and retainer for the sauce cup with the sauce cup actually acting as a structural component in providing a partial support for the open tray, and both a partial support and a locking means for the covered tray.

The foregoing is illustrative of the principals of the invention, and as variations may occur to those skilled in the art, the invention is only to be limited by the scope of the claims following hereinafter.

I claim:

1. A carton for the accommodation of a foodstuff and a sauce cup, said carton comprising a tray with an elongate bottom panel having spaced rear and front ends and laterally spaced sides, a rear wall generally coextensive with and extending upward from said rear end of said bottom panel, opposed side walls each having a length generally coextensive with said laterally spaced sides and extending upward from said laterally spaced sides, an opening defined through said bottom panel between said side walls and proximate said front end for selectively receiving a sauce cup therein and remote from said rear wall wherein an area for foodstuff is provided between said rear wall and said opening, and at least one flap partially overlying said opening and extending transversely between said side walls, said flap being integral with said bottom panel and selectively foldable to depend from said bottom panel and define a partial support for said bottom panel adjacent said front end and elevate said front end relative to said rear end wherein said flap and said rear end define spaced supports for said carton.

2. The carton of claim 1 wherein said rear wall is of a predetermined height, said side walls, adjacent said rear wall, being of substantially equal height with said rear wall, said side walls tapering forwardly along the length thereof to a minimum height less than said predetermined height adjacent said front end of said bottom panel, said bottom panel front end defining an unencumbered free edge, said front end being narrower than said rear end with said side walls converging forwardly from said rear wall to said front end to enable a manual grasping of the carton and a received sauce cup adjacent said front end.

3. The carton of claim 2 wherein said rear wall and said side walls adjacent said rear wall extend substantially perpendicular to said bottom panel, said side walls inclining outward relative to each other at progressively increasing angles between said rear wall and said bottom panel front end.

4. The carton of claim 1 including a second flap laterally spaced from said one flap and partially overlying said opening, said second flap being positioned transversely between said side walls and integral with said bottom panel, said second flap being selectively foldable to depend from said bottom panel upon insertion of a sauce cup in said opening.

5. A carton for the accommodation of a foodstuff and a sauce cup, said carton comprising a tray with an elongate bottom panel having spaced rear and front ends and laterally spaced sides, a rear wall generally coextensive with and extending upward from said rear end of said bottom panel, opposed side walls each having a length generally coextensive with said laterally spaced sides and extending upward from said laterally spaced sides, an opening defined through said bottom panel between said side walls and proximate said front end for selectively receiving a sauce cup therein and remote from said rear wall wherein an area for foodstuff is provided between said rear wall and said opening, and a cover, said cover having an elongate base panel substantially coextensive with said tray bottom panel, said base panel having a front end and a rear end with means for integrally joining said base panel rear end to said tray rear wall for folding movement of said cover relative to said tray between a first closed position covering said tray and a second open position rotated remote from said tray, and an opening defined through said cover base panel proximate said front end of said base panel and aligning with said tray bottom panel opening in said closed position of said cover for selective reception of a sauce cup within and though the aligned openings.

6. The carton of claim 5 wherein said cover is an inverted duplicate of said tray, said means for integrally joining said base panel rear end to said tray rear wall including a rear wall extending from said base panel rear end and integrally joining said tray rear wall, and a fold line defined between said rear walls for a folding of said cover over said tray, said front ends of said bottom panel and said base panel defining unencumbered free edges, said front ends being narrower than the respective rear ends with said tray and said cover progressively narrowing from said rear walls to said front ends to provide a narrower forward portion enabling a manual grasping of the carton and a received sauce cup adjacent said front ends.

7. A carton for the accommodation of a foodstuff and a sauce cup, said carton comprising a tray with an elongate bottom panel having spaced rear and front ends and laterally spaced sides, a rear wall generally coextensive with and extending upward from said rear end of said bottom panel, opposed side walls generally coextensive with and extending upward from said laterally spaced sides, an opening defined through said bottom panel between said side walls and proximate said front end for selectively receiving a sauce cup therein, at least one flap partially overlying said opening and extending transversely between said side walls, said flap being integral with said bottom panel and selectively foldable to depend from said bottom panel and define at least a partial support upon insertion of a sauce cup in said opening, a cover, said cover having an elongate base panel substantially coextensive with said tray bottom panel, said base panel having a front end and a rear end with means for integrally joining said base panel rear end to said tray rear wall for folding movement of said cover relative to said tray between a first closed position covering said tray and a second open position rotated remote from said tray, and an opening defined through said cover base panel proximate said front end of said base panel for alignment with said tray bottom panel opening in said closed position of said cover for selective reception of a sauce cup within and through the aligned openings, a further flap on said cover base panel and partially overlying said base panel opening, said further flap being integral with said base panel and selectively foldable to depend from said base panel into engagement with said one flap on said bottom panel upon insertion of a sauce cup into the aligned openings.

8. The carton of claim 7 including means on said further flap releasably engageable with and below said tray bottom panel to releasably lock said cover to said tray upon insertion of a sauce cup into the aligned openings.

9. A carton for the accommodation of a foodstuff and a sauce cup, said carton comprising a tray with an elongate bottom panel having spaced rear and front ends and laterally spaced sides, a rear wall generally coextensive with and extending upward from said rear end of said bottom panel, opposed side walls each having a length generally coextensive with said laterally spaced sides and extending upward from said laterally spaced sides, and an opening defined through said bottom panel between said side walls and proximate said front end for selectively receiving a sauce cup therein and remote from said rear wall wherein an area for foodstuff is provided between said rear wall and said opening, said bottom panel front end defining an unencumbered free edge, said front end being narrower than said rear end with said side walls converging forwardly from said rear wall to said front end for a manual grasping of the carton and a received sauce cup adjacent said front end, said side walls, at said opening, being spaced from each other at a predetermined distance, said opening being of a transverse width substantially equal to said predetermined distance.

10. A carton and sauce cup for the accommodation of foodstuffs, said carton comprising a tray with a bottom panel having an upper food receiving surface, a bottom surface and a periphery including laterally spaced opposed sides and spaced first and second ends, wall means extending upward from said periphery relative to said upper surface along at least a portion of said sides and said first end for a selective confining of food on said bottom panel, said bottom panel, proximate said second end, defining an opening through said bottom panel selectively receiving said sauce cup therethrough, said opening being remote from said first end, at least one flap integral with said bottom panel along a fold line, said flap extending from said fold line partially across said opening in a first position prior to introduction of said sauce cup through said opening, said flap, upon introduction of said sauce cup, folding downward about said fold line to a second position depending below said bottom surface, said flap and introduced sauce cup forming a support for said tray proximate said second end of said bottom panel.

11. The carton of claim 10 wherein said bottom panel is of a predetermined width at said first end and of a lesser width at said second end to define a tapering configuration between said first end and said second end, said opening having a transverse width between said sides slightly greater than said lesser width.

12. The carton of claim 11 including a cover foldably joined to said bottom panel first end for movement between a first position overlying said tray and a second position remote therefrom, said cover, in said first position, being coextensive with said tray and including a base panel with an opening defined therethrough and in alignment with said tray opening for reception of the sauce cup simultaneously through both openings and a further flap on said cover base panel and partially overlying said base panel opening, said further flap being integral with said base panel and selectively foldable to depend from said base panel into engagement with said one flap on said bottom panel upon insertion of the sauce cup into the aligned openings.

13. A carton formed from a unitary blank and having an elongate, planar bottom panel of a substantially triangular configuration with a rear end of a predetermined width, a free front end of lesser width, and opposed sides converging forwardly from said rear end to said front end, rear and side walls extending, respectively, from said rear end and each of said opposed sides, said side walls converging forwardly from said rear wall to said front end and being of a progressively lesser height from said rear wall to said front end, and an opening defined through said bottom panel in closely spaced relation to said front end and remote from said rear wall, said opening extending transversely between said side walls.

14. The carton of claim 13 including a cover, said cover having an elongate base panel of substantially equal triangular configuration with said bottom panel, said base panel having a front end and a rear end with means for integrally joining said base panel rear end to said rear wall for folding movement of said cover relative to said tray between a first closed position covering said tray and a second open position rotated remote from said tray, and an opening defined through said cover base panel in closely spaced relation to said front end of said base panel and aligning with said bottom panel opening in said closed position of said cover for selective reception of a sauce cup within and through the aligned openings for a retention of said cover in said first closed position.

* * * * *